US008340544B2

(12) United States Patent
Hosoda

(10) Patent No.: US 8,340,544 B2
(45) Date of Patent: Dec. 25, 2012

(54) PRINTING APPARATUS AND CONTROL METHOD WHEREIN A MAINTENANCE TEMPERATURE IS DETERMINED BASED ON PRESET TEMPERATURES

(75) Inventor: Osamu Hosoda, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 368 days.

(21) Appl. No.: 12/463,976

(22) Filed: May 11, 2009

(65) Prior Publication Data

US 2009/0279913 A1 Nov. 12, 2009

(30) Foreign Application Priority Data

May 12, 2008 (JP) ..... 2008-124782

(51) Int. Cl.
*G03G 15/20* (2006.01)
*G03G 15/00* (2006.01)

(52) U.S. Cl. ..... 399/69; 399/45

(58) Field of Classification Search ..... 399/45, 399/69, 70
See application file for complete search history.

(56) References Cited

U.S. PATENT DOCUMENTS

2005/0191076 A1* 9/2005 Dan ..... 399/70
2006/0013608 A1 1/2006 Chae et al.
2007/0140717 A1* 6/2007 Hayashi et al. ..... 399/69
2008/0012927 A1 1/2008 Kimura et al.
2008/0063424 A1* 3/2008 Tanaka et al. ..... 399/79

FOREIGN PATENT DOCUMENTS

| | | | |
|---|---|---|---|
| JP | 7-72678 | | 3/1995 |
| JP | 2005-234065 | A | 9/2005 |
| JP | 2006-285020 | A | 10/2006 |
| JP | 2006-304362 | A | 11/2006 |
| JP | 2007-079188 | A | 3/2007 |
| JP | 2007-148430 | A | 6/2007 |
| KR | 10-2006-0007228 | A | 1/2006 |

* cited by examiner

*Primary Examiner* — Joseph S Wong
(74) *Attorney, Agent, or Firm* — Canon USA, Inc., IP Division

(57) ABSTRACT

A printing apparatus includes a memory used for storing a preset temperature value indicating a preset temperature of a heating portion controlled by a CPU when print processing including transfer processing and fixing processing is performed in association with a plurality of types of sheets that are usable by the printing apparatus. The CPU of the printing apparatus calculates a maintenance temperature value, which is a temperature value to be maintained by the heating portion when the print processing is not performed, based on a plurality of preset temperature values that are set in association with the plurality of types of sheets, and controls the temperature of the heating portion to become equal to the maintenance temperature value.

14 Claims, 18 Drawing Sheets

FIG. 4

401

| SURFACE PROPERTY/GRAMMAGE (gsm) | 64~79 | 80~105 | 106~128 | 129~150 | 151~180 | 181~209 | 210~256 | 257~300 |
|---|---|---|---|---|---|---|---|---|
| PLAIN PAPER | 240 | 240 | 240 | 240 | 240 | 240 | 240 | 240 |
| ONE-SIDED COATED PAPER | 240 | 240 | 240 | 240 | 240 | 240 | 240 | 240 |
| TWO-SIDED COATED PAPER | 240 | 240 | 240 | 240 | 240 | 240 | 240 | 240 |
| RECYCLED PAPER | 240 | 240 | 240 | 240 | 240 | 240 | 240 | 240 |
| EMBOSSED PAPER | 240 | 240 | 240 | 240 | 240 | 240 | 240 | 240 |
| FILM/LABEL | 240 | 240 | 240 | 240 | 240 | NOT SUPPORTED | NOT SUPPORTED | NOT SUPPORTED |
| VELLUM | 240 | 240 | 240 | 240 | 240 | 240 | 240 | 240 |
| COTTON | 240 | 240 | 240 | 240 | 240 | 240 | 240 | 240 |

FIG. 5

501

| SURFACE PROPERTY/GRAMMAGE (gsm) | 64～79 | 80～105 | 106～128 | 129～150 | 151～180 | 181～209 | 210～256 | 257～300 |
|---|---|---|---|---|---|---|---|---|
| PLAIN PAPER | 0 | 0 | 0 | 0 | 0 | 180 | 210 | 240 |
| ONE-SIDED COATED PAPER | 0 | 0 | 0 | 0 | 180 | 180 | 210 | 240 |
| TWO-SIDED COATED PAPER | 0 | 0 | 0 | 0 | 210 | 210 | 240 | 240 |
| RECYCLED PAPER | 0 | 0 | 0 | 0 | 0 | 180 | 210 | 240 |
| EMBOSSED PAPER | 0 | 0 | 0 | 0 | 180 | 180 | 210 | 240 |
| FILM/LABEL | 0 | 0 | 0 | 0 | 0 | NOT SUPPORTED | NOT SUPPORTED | NOT SUPPORTED |
| VELLUM | 0 | 0 | 0 | 0 | 0 | 180 | 210 | 240 |
| COTTON | 0 | 0 | 0 | 0 | 0 | 180 | 210 | 240 |

FIG. 11

1102 1103

| DECK ID | SHEET ID |
|---|---|
| 001 | 0005 |
| 002 | 0014 |
| 003 | 0101 |
| 004 | 0002 |
| 005 | 0002 |

1101

FIG. 12

| | | |
|---|---|---|
| FIRST FIXING ROLLER TEMPERATURE | 240 | 1202 |
| SECOND FIXING ROLLER TEMPERATURE | 0 | 1203 |

1201

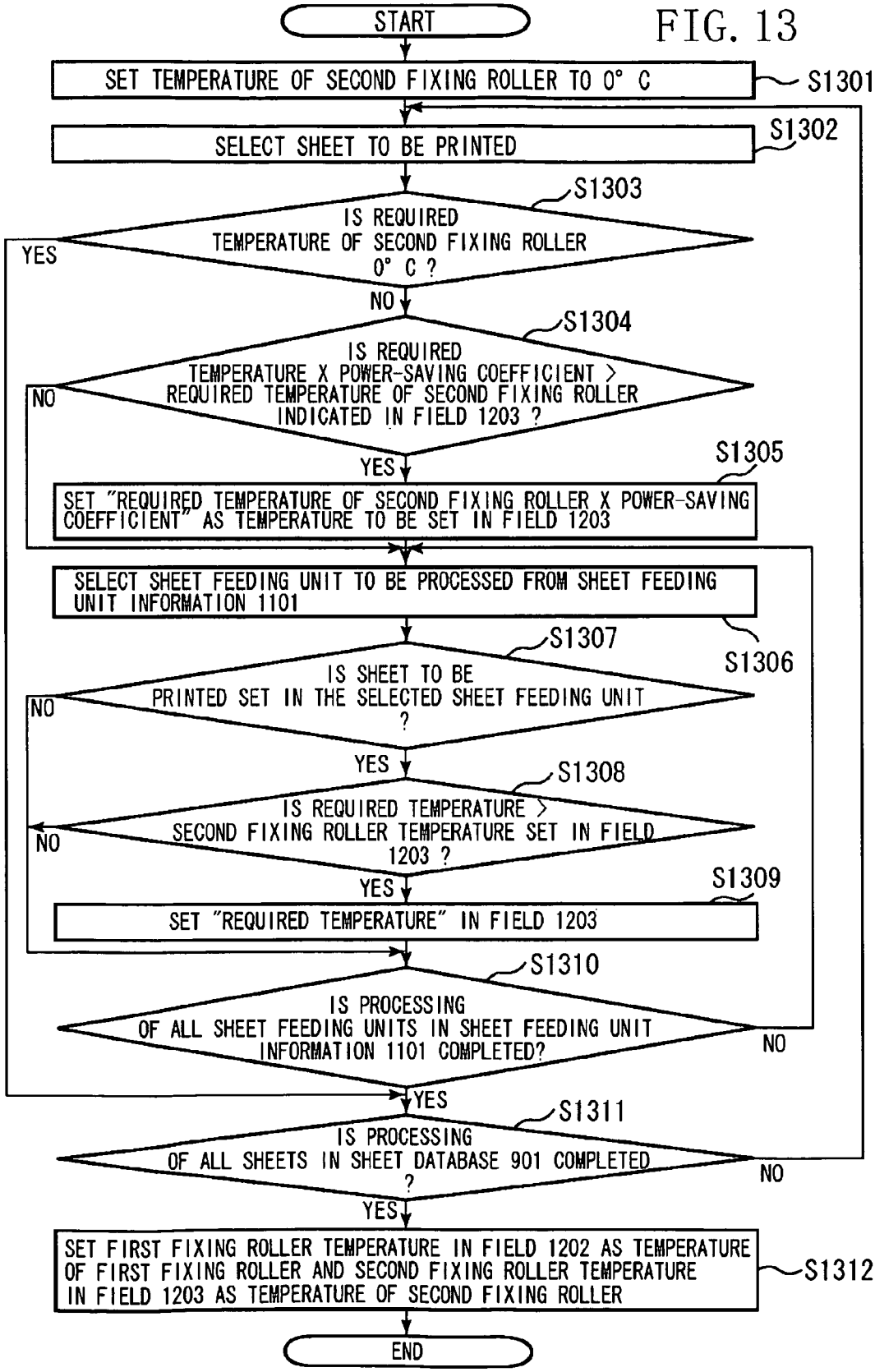
FIG. 13
START
SET TEMPERATURE OF SECOND FIXING ROLLER TO 0° C
S1301
SELECT SHEET TO BE PRINTED
S1302
S1303
IS REQUIRED TEMPERATURE OF SECOND FIXING ROLLER 0° C ?
YES
NO
S1304
IS REQUIRED TEMPERATURE X POWER-SAVING COEFFICIENT > REQUIRED TEMPERATURE OF SECOND FIXING ROLLER INDICATED IN FIELD 1203 ?
NO
YES
S1305
SET "REQUIRED TEMPERATURE OF SECOND FIXING ROLLER X POWER-SAVING COEFFICIENT" AS TEMPERATURE TO BE SET IN FIELD 1203
SELECT SHEET FEEDING UNIT TO BE PROCESSED FROM SHEET FEEDING UNIT INFORMATION 1101
S1306
S1307
IS SHEET TO BE PRINTED SET IN THE SELECTED SHEET FEEDING UNIT ?
NO
YES
S1308
IS REQUIRED TEMPERATURE > SECOND FIXING ROLLER TEMPERATURE SET IN FIELD 1203 ?
NO
YES
S1309
SET "REQUIRED TEMPERATURE" IN FIELD 1203
S1310
IS PROCESSING OF ALL SHEET FEEDING UNITS IN SHEET FEEDING UNIT INFORMATION 1101 COMPLETED?
NO
YES
S1311
IS PROCESSING OF ALL SHEETS IN SHEET DATABASE 901 COMPLETED ?
NO
YES
SET FIRST FIXING ROLLER TEMPERATURE IN FIELD 1202 AS TEMPERATURE OF FIRST FIXING ROLLER AND SECOND FIXING ROLLER TEMPERATURE IN FIELD 1203 AS TEMPERATURE OF SECOND FIXING ROLLER
S1312
END

FIG. 19

STORAGE MEDIUM SUCH AS FD, CD-ROM

| DIRECTORY INFORMATION |
| --- |
| PROGRAM CODE CORRESPONDING TO STEPS IN FLOWCHART ILLUSTRATED IN FIG. 13 |
| PROGRAM CODE CORRESPONDING TO STEPS IN FLOWCHART ILLUSTRATED IN FIG. 15 |
| PROGRAM CODE CORRESPONDING TO STEPS IN FLOWCHART ILLUSTRATED IN FIG. 16 |
| PROGRAM CODE CORRESPONDING TO STEPS IN FLOWCHART ILLUSTRATED IN FIG. 17 |
| PROGRAM CODE CORRESPONDING TO STEPS IN FLOWCHART ILLUSTRATED IN FIG. 18 |

PRINTING APPARATUS AND CONTROL METHOD WHEREIN A MAINTENANCE TEMPERATURE IS DETERMINED BASED ON PRESET TEMPERATURES

BACKGROUND OF THE INVENTION

1. Field of the Invention

The present invention relates to a printing apparatus and a control method for the printing apparatus.

2. Description of the Related Art

In fixing toner transferred onto a sheet using electrophotographic printing apparatuses, heat and pressure are applied to the sheet. Such an electrophotographic printing apparatus includes a fixing unit for applying heat and pressure to a sheet. The amount of heat and pressure required in fixing toner onto a sheet varies depending on characteristics of the sheet, including thickness and surface property thereof.

Japanese Patent Application Laid-Open No. 7-72678 discusses a method in which when a mode of a printing apparatus is specified by a user via an operation panel according to characteristics of a sheet, a fixing temperature that is adapted for the specified mode is set, and printing is started when the temperature of the fixing unit becomes the temperature which has been set.

However, changing a preset fixing temperature only after the mode is specified via the operation panel of the printing apparatus according to the sheet characteristics requires a considerable amount of time before the printing is actually started.

SUMMARY OF THE INVENTION

The present invention is directed to a printing apparatus that is capable of reducing power consumption of an image fixing unit without decreasing throughput of printing.

According to an aspect of the present invention, a printing apparatus includes a fixing unit configured to perform fixing processing for fixing a toner image to a sheet by heating the sheet with a heating portion, a storage unit, and a control unit configured to control a heating portion to maintain a maintenance temperature during a period when print processing is not performed, the control unit further being configured to determine the maintenance temperature based on values stored in the storage unit and a plurality of types of sheets identified in the printing apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a table illustrating a relationship between temperature setting required in driving a fixing roller included in the first fixing unit illustrated in FIG. 1 during printing, and the surface property and grammage of a sheet.

FIG. 5 is a table illustrating a relationship between temperature setting required in driving a fixing roller included in the second fixing unit illustrated in FIG. 1 during printing, and the surface property and grammage of a sheet.

FIG. 11 is a block diagram illustrating a data structure used for storing sheet information of a sheet set in a sheet feeding unit or in a different type of sheet feeding unit.

FIG. 12 illustrates a data format of a temperature management table used for setting a temperature value of each fixing roller included in the first and the second fixing units.

FIG. 13 illustrates procedures for controlling the fixing unit when the mode of the printing apparatus is changed to a power saving mode according to a first exemplary embodiment of the present invention.

FIG. 19 is a memory map of a storage medium (recording medium) configured to store various types of data processing programs which can be read out by the printing apparatus according to an exemplary embodiment of the present invention.

DETAILED DESCRIPTION OF THE EMBODIMENTS

Various exemplary embodiments, features, and aspects of the invention will be described in detail below with reference to the drawings.

Description Common to all Embodiments

Figure 1:
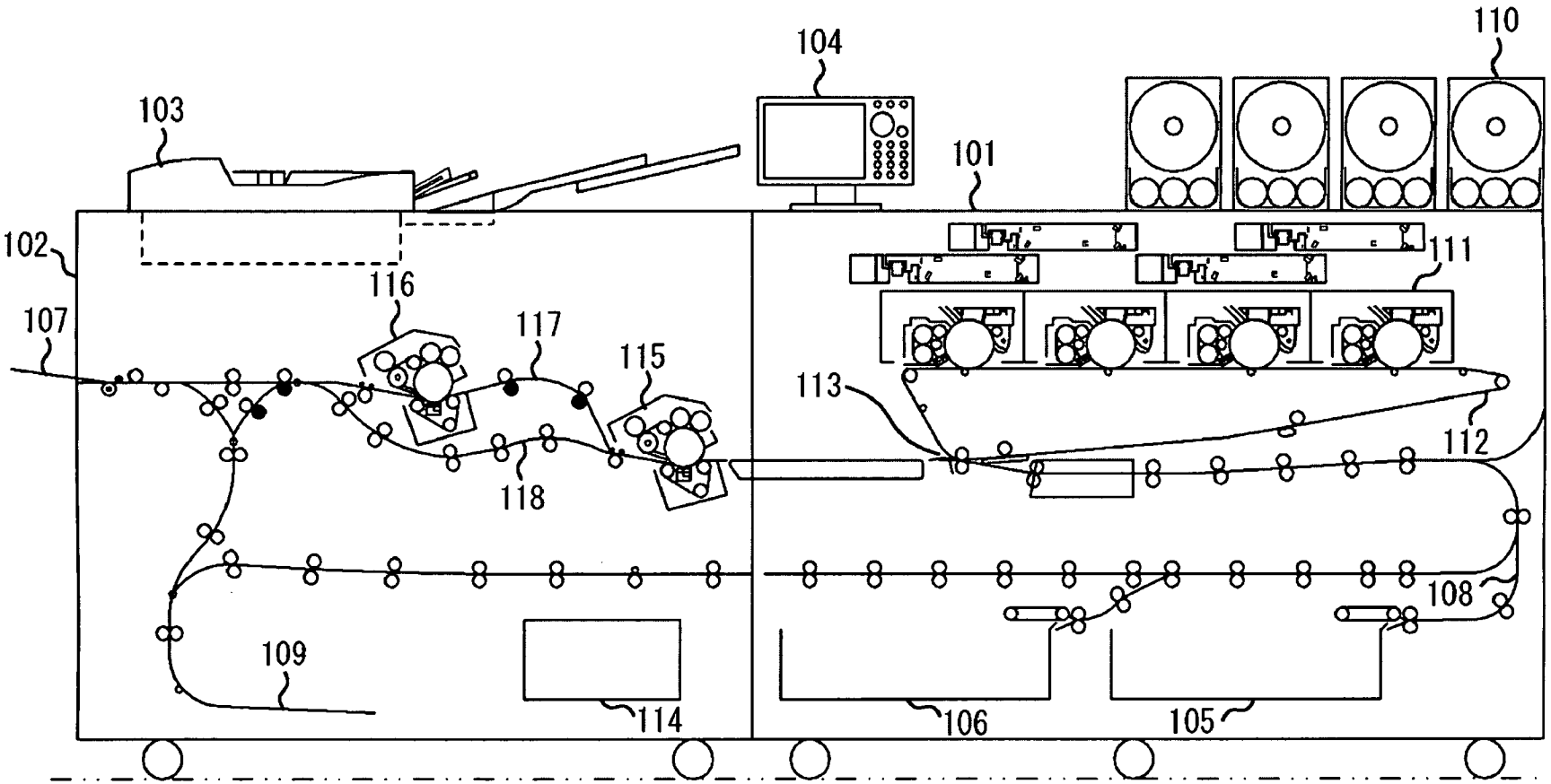
FIG. 1 is a cross section of a configuration of a printing apparatus according to an exemplary embodiment of the present invention.

FIG. 1 illustrates a cross section of a configuration of a printing apparatus according to a first exemplary embodiment of the present invention.

In FIG. 1, an exterior 101 is configured to store an image forming portion of the printing apparatus. An exterior 102 is configured to store a fixing portion of the printing apparatus. A scanner unit 103 is configured to scan a document and generate electronic image data. An operation unit 104 is used by a user to issue various instructions to the printing apparatus to operate the printing apparatus. The operation unit 104 includes a touch panel. Various operations are performed when the user touches (presses) the screen displayed on the touch panel.

A first sheet feeding unit 105 and a second sheet feeding unit 106 are sheet feeding units in which a print medium (hereinafter referred to as a sheet) which is to be printed by the printing apparatus is set.

A sheet discharging unit 107 discharges a printed sheet outside of the printing apparatus. A conveyance path 108 is a path used for conveying a sheet. A switchback unit 109 reverses a sheet when the sheet is discharged to the sheet discharging unit 107.

A toner replenishing unit 110 replenishes the first transfer unit described below with developer (hereinafter referred to as toner). A first transfer unit 111 transfers a toner image which is formed using the toner replenished by the toner replenishing unit 110 onto a sheet conveyed from the first sheet feeding unit 105 or the second sheet feeding unit 106. A transfer belt 112 is a belt onto which the toner image is transferred by the first transfer unit. A second transfer unit 113 transfers the toner image transferred onto the transfer belt 112 onto a sheet. A waste toner container 114 contains residual toner in the transfer processing.

A first fixing unit 115 performs fixing processing by applying heat and pressure to the sheet onto which a toner image is transferred by the second transfer unit 113.

A second fixing unit 116 applies additional heat and pressure to the image onto which the toner image is fixed by the first fixing unit 115 to enhance fixing of the image.

A conveying portion 117 is used for conveying a sheet from the first image fixing unit 115 to the second fixing unit 116. A conveying portion 118 is used for conveying a sheet from the first fixing unit 115 to the sheet discharging unit 107 or the switchback unit 109 without the sheet passing through the second fixing unit 116.

The printing apparatus according to the present exemplary embodiment includes a function that changes a mode of the printing apparatus to a power saving mode when the printing apparatus is in a print waiting state to reduce power consumption. The user can change the mode of the printing apparatus to the power saving mode by using the operation unit 104. When the printing apparatus is in the power saving mode, processing for reducing power consumption of each component that consumes power of the printing apparatus is performed by a main controller 301 described below referring to FIG. 3.

Figure 2:
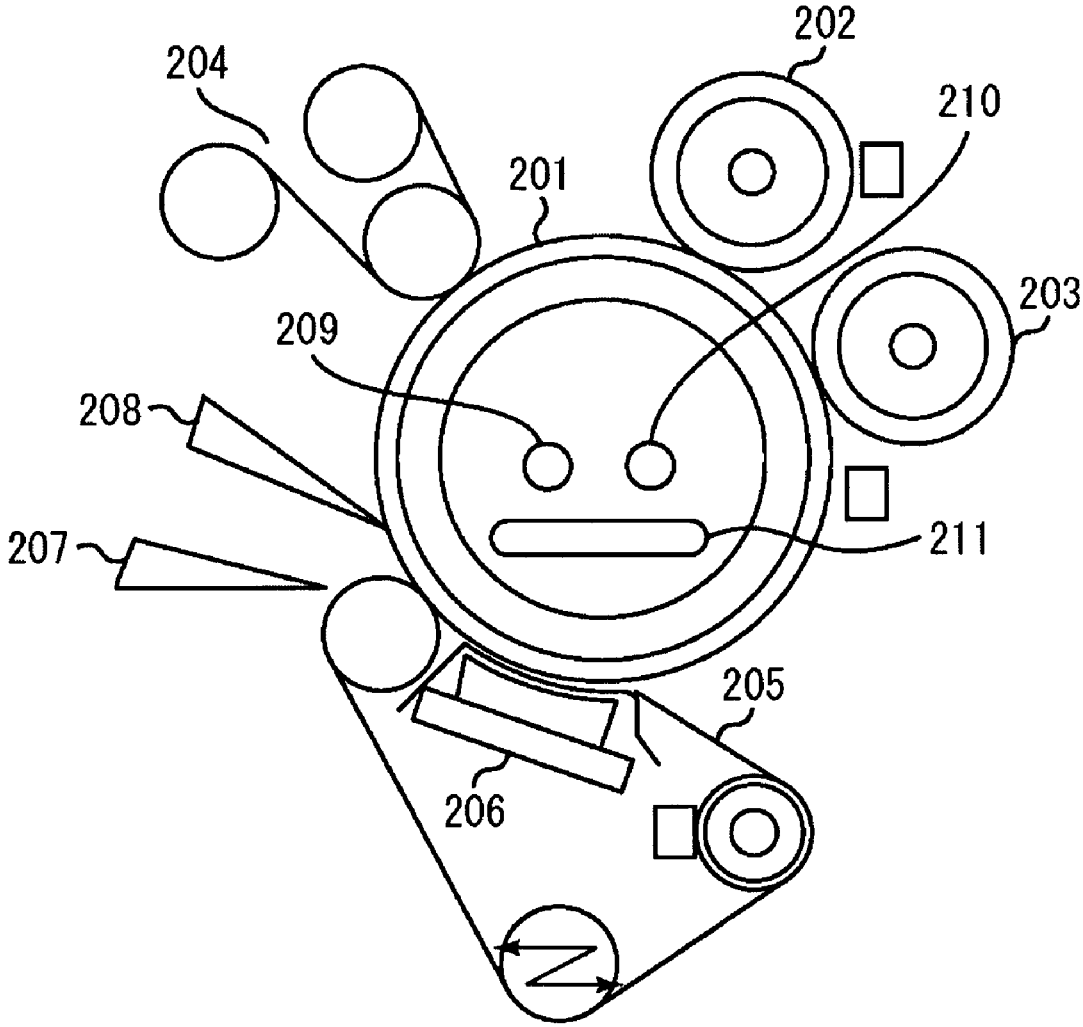
FIG. 2 illustrates a configuration of a first fixing unit and a second fixing unit illustrated in FIG. 1.

FIG. 2 illustrates a configuration of the first fixing unit 115 and the second fixing unit 116 illustrated in FIG. 1.

In FIG. 2, a fixing roller 201 is used for applying heat onto a sheet. The fixing roller 201 includes a first heater 209 and a second heater 210. Each of the first heater 209 and the second heater 210 functions as a heating portion used for applying heat to a sheet onto which the toner image is transferred. Temperature of each heater is controlled by a central processing unit (CPU) 305.

A first external heating roller 202 and a second external heating roller 203 apply heat onto the fixing roller 201 from outside of the fixing roller 201.

A cleaning web 204 cleans the fixing roller 201. A conveying belt 205 conveys the sheet conveyed to the fixing unit while the sheet contacts the fixing roller 201. A pressure pad 206 applies pressure to the sheet that contacts the fixing roller 201.

A first sheet separation claw 207 and a second sheet separation claw 208 remove the sheet that contacts the fixing roller 201 from the fixing roller 201.

A thermistor 211 measures a temperature of the fixing roller 201. The main controller 301 described below referring to FIG. 3 is notified of the temperature measured by the thermistor 211.

The fixing roller 201, the first external heating roller 202, the second external heating roller 203, and the conveying belt 205 each include a heater (heating portion). Each heater includes mechanism for adjusting temperature independently (independently controllable) so that an optimum amount of heat can be applied to a sheet onto which the toner image is fixed depending on its sheet type. The temperatures of the heaters are controlled by the CPU 305.

Figure 3:
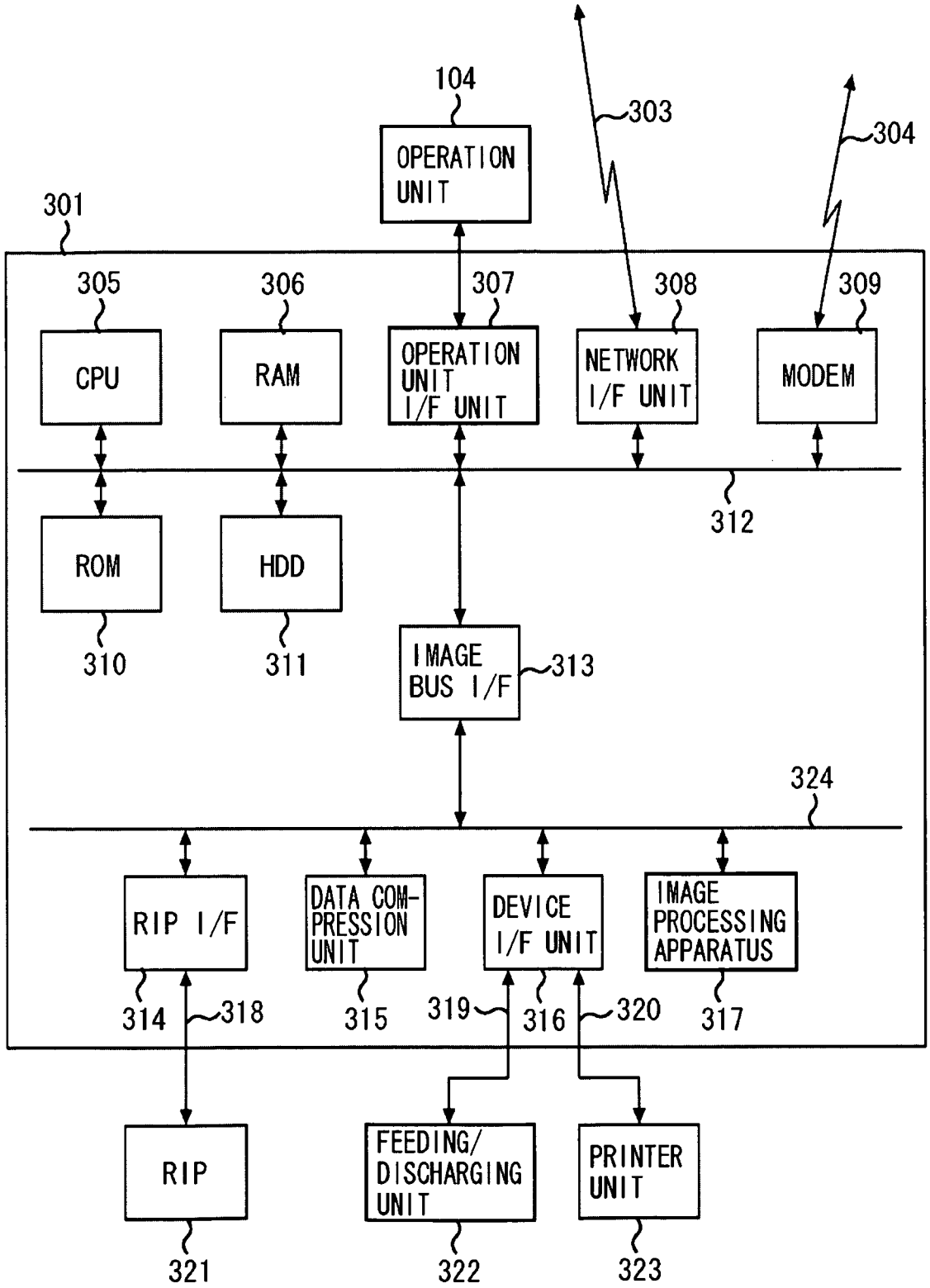
FIG. 3 is a block diagram illustrating a configuration of a main controller of the printing apparatus according to an exemplary embodiment of the present invention.

FIG. 3 is a block diagram illustrating a configuration of the main controller of the printing apparatus according to the present exemplary embodiment.

In FIG. 3, the main controller 301 controls the printing apparatus. A network cable 303 connects an external device to the main controller 301 via a network. A cable 304 connects an external device to the main controller 301 via a telephone line.

The CPU 305 executes a program that controls the operation of the main controller 301. A random access memory (RAM) 306 is managed by a program that is executed by the CPU 305. The RAM 306 is used as a buffer for temporarily storing data sent from an external device or for temporarily storing image data rasterized by a raster image processor (RIP).

An operation unit interface (I/F) unit 307 allows the main controller 301 to connect to the operation unit 104. A network I/F unit 308 allows the main controller 301 to connect to a network. An interface 309 allows the main controller 301 to connect to a telephone line.

A read-only memory (ROM) 310 stores data or a program that is executed by the CPU 305. A hard disk (HDD) 311 is a non-volatile storage unit where various data can be held long-term.

A CPU bus 312 and an image bus 324 are also included in the main controller 301. The image bus 324 connects hardware groups that perform image processing. An image bus I/F unit 313 allows the image bus 324 to connect to the CPU bus 312.

A rasterize image processor (RIP) 321 analyzes page description language data input by an external device and converts the analyzed data into bitmap image data. An RIP I/F unit 314 allows the RIP 321 to connect to the image bus 324 via an image transfer bus 318.

A data compressing unit 315 compresses data. A paper feeding and discharging unit 322 and a printer unit 323 are connected to a device I/F unit 316. A configuration of the printer unit 323 is illustrated in FIG. 1.

The device I/F unit 316 connects the printer unit 323 and the paper feeding and discharging unit 322 to the image bus 324 via data buses 319 and 320, respectively.

An image processing unit 317 executes various image processing operations with respect to the bitmap image data generated by the RIP 321. The image processing unit 317 is capable of digitally processing the bitmap image data. For example, the image processing unit 317 can convert bitmap image data of two pages into bitmap image data of one page.

According to a signal sent from the operation unit 104 or sent from an external device via the network cable 303, the CPU 305 issues a command to the printer unit 323 and the paper feeding and discharging unit 322 via the data buses 319 and 320 so as to perform printing.

First Embodiment

FIG. 4 illustrates a table 401 including a temperature of the fixing roller 201, included in the first fixing unit 115 illustrated in FIG. 1, required in executing the fixing processing. The temperature is associated with the surface property and grammage (grams per square meter) of a plurality of types of sheets that are usable by the printing apparatus. This fixing roller 201 is hereinafter referred to as a first fixing roller. The data in the table 401 is stored in the RAM 306 or the hard disk 311 included in the printing apparatus as a storage unit.

In fixing a toner image onto a sheet, the first fixing roller in the first fixing unit 115 is required to maintain a predetermined preset temperature value shown in the table 401. According to the table 401, a preset temperature value of the first fixing unit 115 required in executing the fixing processing is determined depending on a type of the sheet (surface property and grammage) onto which the toner image is fixed. In this table, the preset temperature value realized by the first heater 209 and the second heater controlled by the CPU 305 when the first fixing unit 115 executes the fixing processing is provided according to the sheet type.

FIG. 5 illustrates a table 501 including a temperature of the fixing roller 201, included in the second fixing unit 116 illustrated in FIG. 1, required in executing the fixing processing. The temperature is associated with the surface property and grammage of a plurality of types of sheets that are usable by the printing apparatus. This fixing roller 201 is hereinafter referred to as a second fixing roller. The data in the table 501 is stored in the RAM 306 or the hard disk 311 included in the printing apparatus as a storage unit.

In fixing a toner image onto a sheet (i.e., in printing the image), the second fixing roller included in the second fixing unit 116 is required to maintain a predetermined preset temperature value shown in the table 501. According to the table 501, a preset temperature value of the second fixing unit 116 required in executing the fixing processing is determined depending on the characteristics of the sheet (surface property and grammage) onto which the toner image is fixed. In this table, the preset temperature values realized by the first heater 209 and the second heater controlled by the CPU 305 when the second fixing unit 116 executes the fixing processing is provided according to the sheet type.

Each temperature of the first heater 209 and the second heater 210 in the fixing roller 201 that is required in the power saving mode (maintenance temperature value) can be obtained by multiplying a temperature value defined in the table 501 by a predetermined power-saving coefficient. When the printing apparatus is in the power saving mode, the print processing including the fixing processing by the first fixing unit 115 or the second fixing unit 116 is not executed.

The power-saving coefficient is a value that is 0 or more but 1 or less (e.g., "0.7"). The value is set at the time the printing apparatus is shipped or set by an administrator of the printing apparatus in advance and stored in the ROM 310 or the hard disk 311 of the main controller 301.

Figure 6:
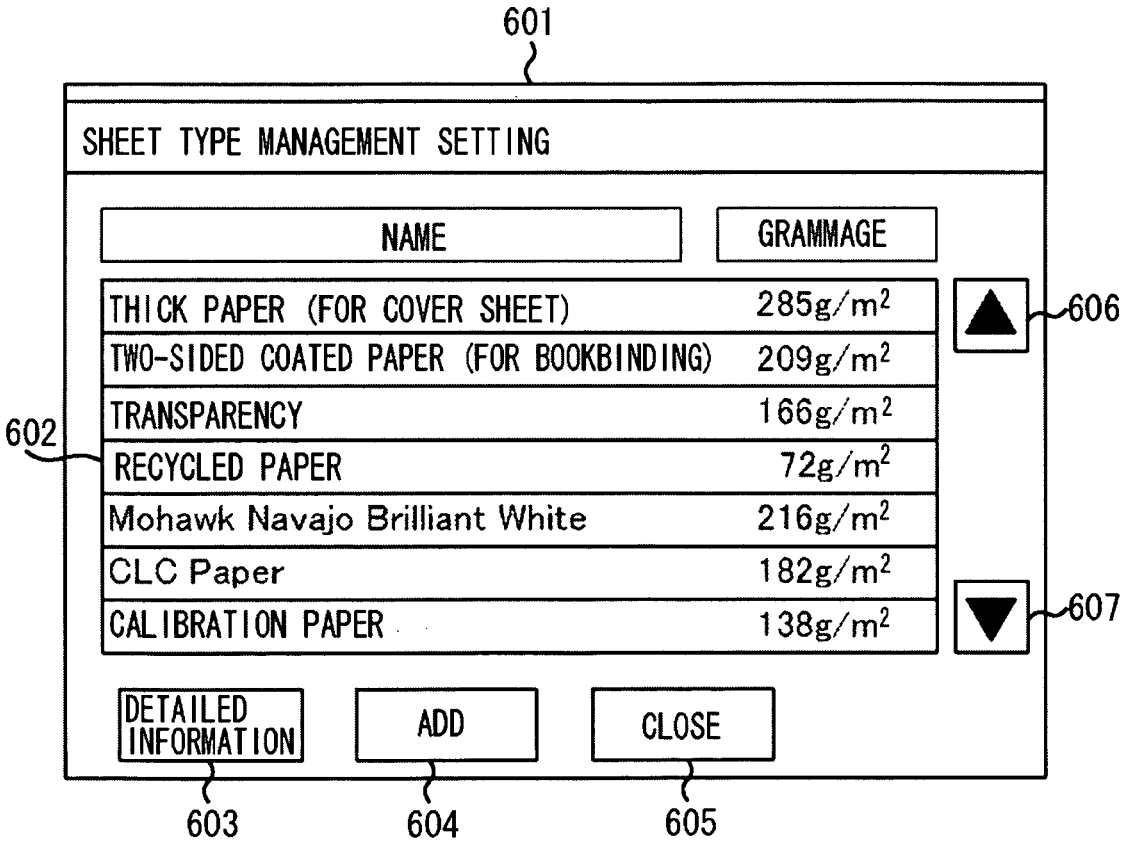
FIG. 6 illustrates a screen of an operation unit used in registering a type of sheet that can be used in the printing apparatus according to an exemplary embodiment of the present invention.

FIG. 6 illustrates a screen of the operation unit 104 used in registering a type of sheet that can be used in the printing apparatus of the present exemplary embodiment.

A screen 601 is displayed on the touch panel of the operation unit 104 when the CPU 305 executes a program stored in the ROM 310.

A sheet name display portion 602 is used for specifying a type of sheet registered as printable by the printing apparatus. The user presses a detailed information button 603 to display detailed information of the specified sheet.

An add button 604 is pressed when the user adds a new sheet. A close button 605 is pressed when the user closes the screen. Scroll boxes 606 and 607 are used for displaying a sheet name that cannot be displayed on the sheet name display portion 602 without scrolling.

Figure 7:
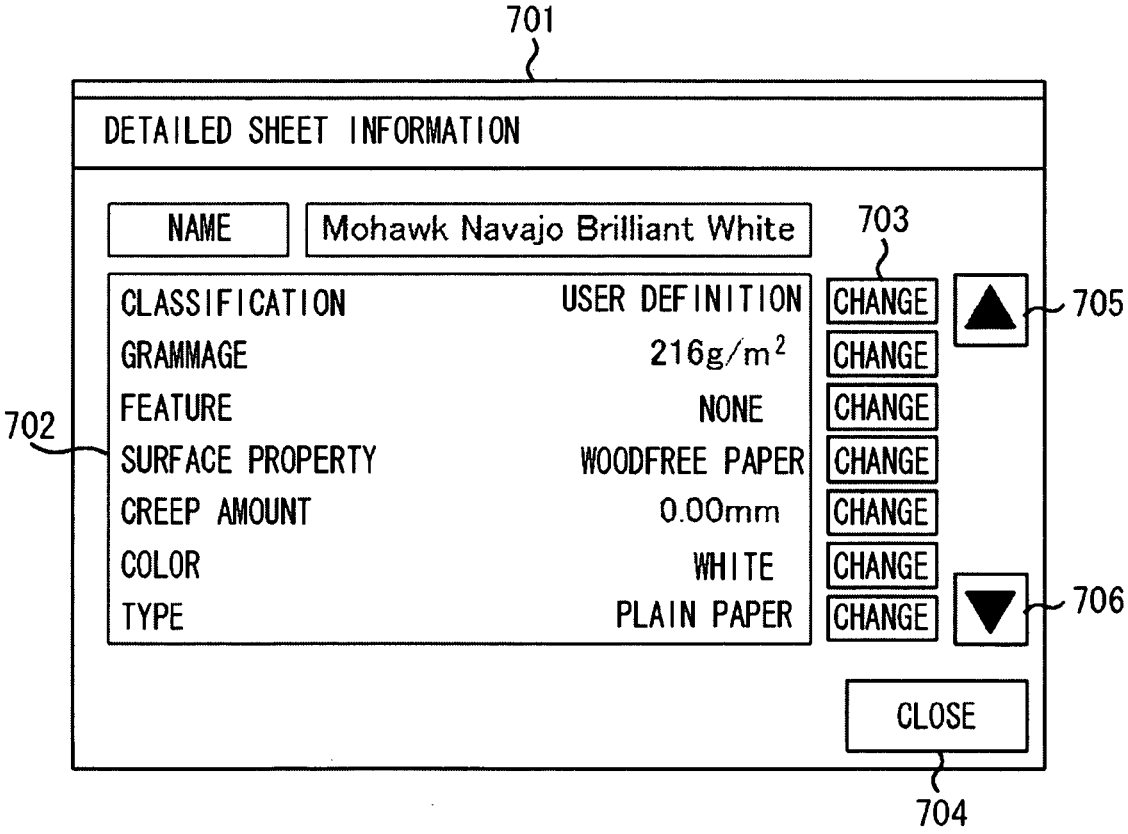
FIG. 7 is a screen used for displaying detailed information of a sheet when a detailed information button illustrated in FIG. 6 is pressed by a user.

When the user presses (touches) the detailed information button 603, a screen 701 illustrated in FIG. 7 is displayed on the touch panel of the operation unit 104.

FIG. 7 is a screen that displays detailed information of a sheet when the detailed information button 603 illustrated in FIG. 6 is pressed by the user.

A screen 701 is displayed on the touch panel of the operation unit 104 when the CPU 305 executes a program stored in the ROM 310.

A sheet information display unit 702 displays characteristics of a selected sheet and a temperature value required in fixing the selected sheet as attribute information. A change button 703 is pressed when the user changes the attribute information. A close button 704 is pressed when the user finishes the processing using the screen 701.

Scroll boxes 705 and 706 are used for displaying attribute information of a sheet that cannot be displayed on the sheet information display unit 702 without scrolling.

Figure 8:
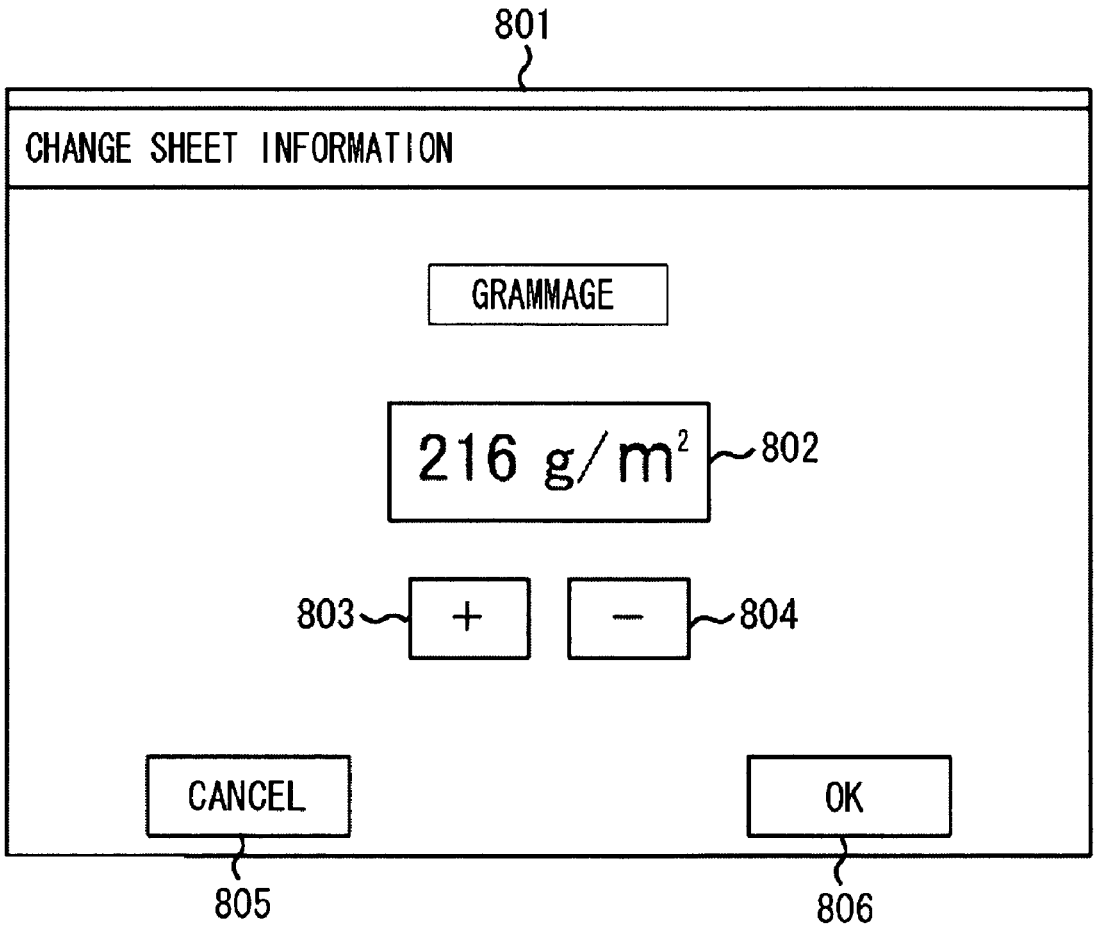
FIG. 8 is a screen used for changing a control value of a sheet which is displayed when the user presses a change button illustrated in FIG. 7.

When the user presses (touches) the change button 703, a screen 801 illustrated in FIG. 8 is displayed on the touch panel of the operation unit 104.

FIG. 8 is a screen used for changing attribute information of a sheet. This screen is displayed when the user presses the change button 703 illustrated in FIG. 7. FIG. 8 illustrates a screen that is displayed when grammage of the sheet is changed by the user.

A screen 801 is displayed on the touch panel of the operation unit 104 when the CPU 305 executes a program stored in the ROM 310.

In the screen 801, attribute information of the selected sheet is displayed on an attribute information display field 802. In FIG. 8, a grammage value is displayed on the display field 802.

Buttons 803 and 804 are used for changing the attribute information. The attribute information displayed on the attribute information display field 802 is changed when the user presses the buttons 803 and 804. In other words, the CPU 305 changes the attribute information displayed on the attribute information display field 802 according to the operation of the buttons 803 and 804.

A cancel button 805 is used for canceling the setting displayed on the screen 801. An OK button 806 is used for confirming the setting displayed on the screen 801.

Figure 9:
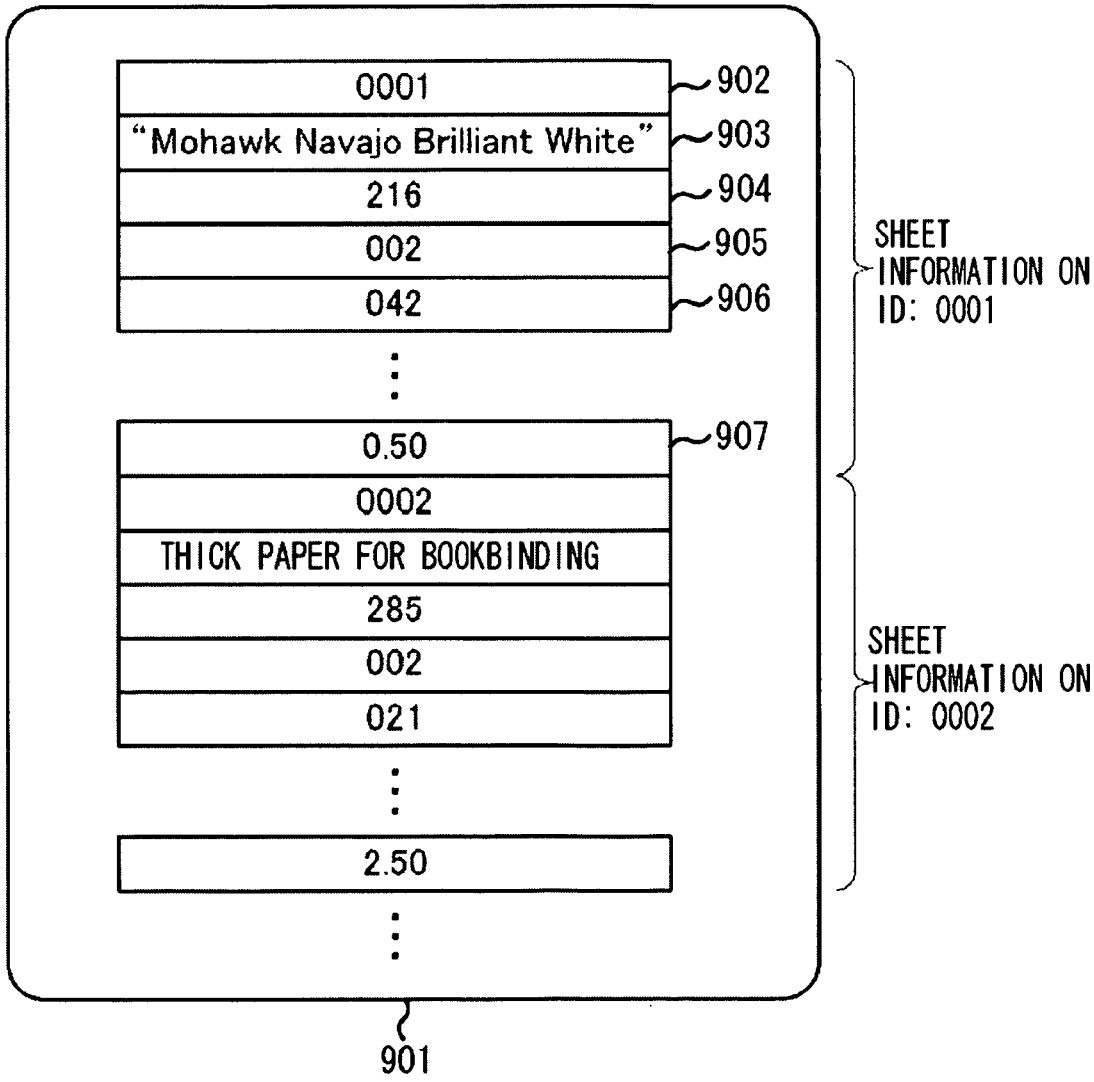
FIG. 9 illustrates a data format of the sheet information illustrated in FIGS. 6 to 8 when the information is stored in a storage unit in the printing apparatus.

FIG. 9 illustrates a data format of the sheet information illustrated in FIGS. 6 to 8 when the information is stored in a storage unit in the printing apparatus.

In FIG. 9, a sheet database 901 illustrates the entire data format. Data in the sheet database 901 is stored in the RAM 306 or the hard disk 311 as a database for managing the sheet information.

In the sheet database 901, an identifier (sheet ID) used for identifying a sheet type registered in the printing apparatus is displayed in a field 902. A name of the sheet registered in the printing apparatus is displayed in a field 903.

A grammage of the registered sheet is displayed in a field 904. Further, a value used for identifying a surface property of the registered sheet is displayed in a field 905. Surface property information is assigned in advance to the value displayed in the field 905.

A number used for identifying a shape of the registered sheet is displayed in a field 906. Shape information is assigned in advance to the number displayed in the field 906. An amount of saddle stitch creep of the registered sheet is displayed in a field 907. The amount of creep displayed in the field 907 is used for adjusting image widths of a plurality of pages when the sheets are saddle-stitched.

The attribute information of the sheet ID: 0001 illustrated in FIG. 9 is an example of a configuration of the present embodiment and attribute information other than the above-described information is included in the present invention.

As described above, the user can register a type (surface property and grammage) of a print medium that is to be printed by the printing apparatus in the RAM 306 or the hard disk 311 according to a format illustrated in FIG. 9 using the screens illustrated in FIGS. 6 to 8.

Figure 10:
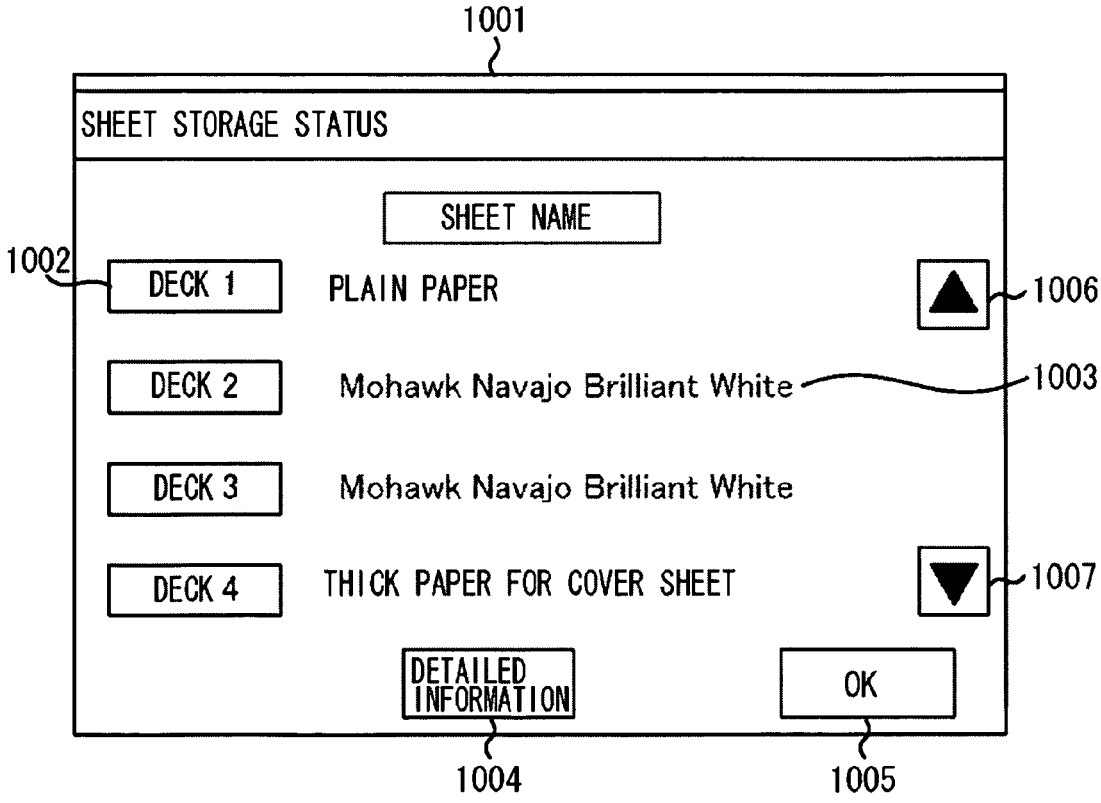
FIG. 10 is a screen used for viewing sheet information on a sheet set in a sheet feeding unit or in a different type of sheet feeding unit of the printing apparatus.

FIG. 10 is a screen used for viewing sheet information on a sheet set in the sheet feeding unit 105 or 106 or in a different sheet feeding unit of the printing apparatus.

A screen 1001 is displayed on the touch panel of the operation unit 104 when the CPU 305 executes a program stored in the ROM 310.

In the screen 1001, a character string used for identifying the sheet feeding unit is displayed in a field 1002. A character string used for identifying a name of a sheet set in the sheet feeding unit is displayed in a field 1003.

A detailed information button 1004 is used for displaying attribute information of a selected sheet. When the user presses (touches) the detailed information button 1004, a screen (not shown) used for displaying detailed information of the selected sheet is displayed on the touch panel of the operation unit 104. An OK button 1005 is pressed by the user when the user confirms the setting on the screen 1001. Scroll boxes 1006 and 1007 are used for displaying sheet feeding units that cannot be displayed on the sheet feeding unit information screen without scrolling.

FIG. 11 illustrates a data structure used for storing a sheet ID of a sheet set in the sheet feeding unit 105 or 106 or in a different sheet feeding unit.

Data on the sheet ID is stored in a database used for managing the sheet information. The database is stored in the RAM 306 or the hard disk 311 and changed according to an operation entered via the screen 1001 illustrated in FIG. 10.

In FIG. 11, sheet feeding unit information 1101 is information on a sheet feeding unit. Identification number of the sheet feeding unit is displayed in a field 1102. Identification number (sheet ID) which is a type of sheet set in the sheet feeding unit is displayed in a field 1103. The sheet ID displayed in the field 1103 is selected from the sheet IDs displayed in the field 902 illustrated in FIG. 9.

FIG. 12 is a data format of a temperature management table used for setting a preset temperature value of each heater included in the first and the second fixing units 115 and 116 at the time each fixing roller executes the fixing processing.

In FIG. 12, data in a temperature management table 1201 is stored in the RAM 306 or the hard disk 311 in the form of a temperature management table used for setting temperature information at the time each fixing roller performs the fixing processing.

A temperature of the fixing roller 201 in the first fixing unit 115 required in executing the fixing processing is displayed in a field 1202. This temperature is referred to as a first fixing roller temperature. A temperature of the fixing roller 201 in the second fixing unit 116 required in executing the fixing processing is displayed in a field 1203. This temperature is referred to as a second fixing roller temperature.

Next, control processing of the fixing unit will be described referring to the flowchart illustrated in FIG. 13 according to the first exemplary embodiment of the present invention.

The flowchart in FIG. 13 illustrates procedures for controlling the fixing unit when the mode of the printing apparatus is changed to the power saving mode according to the first exemplary embodiment of the present invention. The control steps in the flowchart are realized by the CPU 305 executing a program stored in the ROM 310.

The control steps in the flowchart illustrated in FIG. 13 are executed when registration of a sheet type is instructed via the operation unit 104 or the network cable 303 at the time the mode of the printing apparatus is changed to the power saving mode. The control steps in the flowchart are also executed when the content of the table in FIG. 5 is changed or when replenishment or replacement of sheets in the sheet feeding unit 105 or 106 is performed, at the time the mode of the printing apparatus is changed to the power saving mode.

According to the present exemplary embodiment, the maintenance temperature value of the fixing roller 201 in the first fixing unit 115 in the power saving mode is 240° C. regardless of the sheet type.

First, in step S1301, the CPU 305 initializes the temperature in the field 1203 illustrated in FIG. 12, or, in other words, sets the temperature of the second fixing roller included in the fixing roller 201 in the second fixing unit 116 displayed in the field 1203 to "0° C.". The temperature of the second fixing roller is based on the temperature of the first heater 209 and the temperature of the second heater 210. The temperature displayed in the field 1203 is a maintenance temperature value which the second fixing roller in the power saving mode is required to maintain. Next, in step S1302, the CPU 305 selects a sheet to be processed from the sheets in the sheet database 901.

Next, in step S1303, the CPU 305 obtains a required temperature of the second fixing roller with respect to the sheet selected in step S1302 based on the required temperature of the second fixing roller shown in the table 501 in FIG. 5. If the required temperature is 0° C. (YES in step S1303), then the process proceeds to step S1311.

On the other hand, in step S1303, if the required temperature of the second fixing roller with respect to the sheet selected in step S1302 is not 0° C. (NO in step S1303), the process proceeds to step S1304. In step S1304, the CPU 305 compares the required temperature of the second fixing roller with respect to the sheet selected in step S1302 (i.e., the temperature obtained in step S1303) multiplied by the power-saving coefficient stored in the ROM 310 and the temperature of the second fixing roller displayed in the field 1203

If the temperature obtained by the calculation in step S1304 is lower than or equal to the temperature of the second fixing roller displayed in the field 1203 (NO in step S1304), then the process proceeds to step S1306.

On the other hand, if the temperature obtained by the calculation in step S1304 is higher than the temperature of the second fixing roller displayed in the field 1203 (YES in step S1304), then the process proceeds to step S1305.

In step S1305, the CPU 305 sets the value obtained by multiplying the required temperature of the second fixing roller with respect to the sheet selected in step S1302 by the power-saving coefficient as the temperature to be set in the field 1203 of the second fixing roller temperature. In step S1306, the CPU 305 selects a sheet feeding unit that goes through steps S1307 through S1309. The sheet feeding unit is selected from the sheet feeding units included in the sheet feeding unit information 1101. For example, a sheet feeding unit of deck ID: 001 is selected.

In step S1307, the CPU 305 determines whether the sheet selected in step S1302 is set in the sheet feeding unit selected in step S1306 according to the sheet feeding unit information 1101. In other words, if the sheet displayed in the field 902 which is selected in step S1302 is the same type of sheet as the sheet that corresponds to the sheet feeding unit displayed in the field 1102 (the sheet feeding unit has been selected in step S1306), the CPU 305 determines that the sheet selected in step S1302 is set in the sheet feeding unit selected in step S1306. On the other hand, if the sheet displayed in the field 902 which is selected in step S1302 is different from the sheet having a sheet ID (sheet ID 1103) corresponding to the sheet feeding unit displayed in the field 1102 and which has been selected in step S1306, then the CPU 305 determines that the sheet selected in step S1302 is not set in the sheet feeding unit selected in step S1306.

In step S1307, if the CPU 305 determines that the sheet selected in step S1302 is not set in the sheet feeding unit selected in step S1306 (NO in step S1307), then the process proceeds to step S1310.

On the other hand, if the CPU 305 determines that the sheet selected in step S1302 is set in the sheet feeding unit selected in step S1306 (YES in step S1307), then the process proceeds to step S1308.

In step S1308, the CPU 305 obtains the temperature of the second fixing roller required in printing the sheet selected in step S1302 according to the table 501 illustrated in FIG. 5, and compares the obtained value and the second fixing roller temperature set in the field 1203. If the CPU 305 determines that the obtained value is lower than or equal to the second fixing roller temperature set in the field 1203 (NO in step S1308), then the process proceeds to step S1310.

On the other hand, in step S1308, if the CPU 305 determines that the obtained value is higher than the second fixing roller temperature set in the field 1203 (YES in step S1308), then the process proceeds to step S1309.

In step S1309, the CPU 305 sets the temperature of the second fixing roller required in printing the sheet selected in step S1302 as the temperature of the second fixing roller to be set in the field 1203. In step S1310, the CPU 305 determines whether the selection of all of the sheet feeding units is completed. If the CPU 305 determines that the selection of all of the sheet feeding units is not completed or a sheet feeding unit that has not been subjected to the processing in steps S1307 to S1309 exists (NO in step S1310), then the process returns to step S1306.

On the other hand, in step S1310, if the CPU 305 determines that the selection of all of the sheet feeding units is completed (YES in step S1310), then the process proceeds to step S1311.

In step S1311, the CPU 305 determines whether the processing of all of the sheets registered in the sheet database 901 in step S1302 is completed. If the CPU 305 determines that the processing of all of the sheets registered in the sheet database 901 is not completed or a sheet that has not been subjected to the processing in steps S1303 to S1309 exists (NO in step S1311), then the process returns to step S1302.

On the other hand, in step S1311, if the CPU 305 determines that the processing of all of the sheets registered in the sheet database 901 is completed (YES in step S1311), then the process proceeds to step S1312.

In step S1312, the CPU 305 sets the temperature value indicated in the field 1202 as the temperature of the first fixing roller, and also sets the temperature value indicated in the field 1203 as the temperature of the second fixing roller, and then the process ends.

According to the flowchart illustrated in FIG. 13, temperatures that the first heater 209 and the second heater 210 of the second fixing roller need to maintain (maintenance temperature values) when the second fixing unit 116 is not performing the fixing processing are calculated in step S1305 or step S1309. Further, the maintenance temperature value of each of the plurality of sheets set in the storage unit is calculated in step S1305 or step S1309, and the maximum value of the calculated maintenance temperature values is used as the final maintenance temperature value. Then, the CPU 305 controls the first heater 209 and the second heater 210 included in the second fixing roller so that the temperature of the second fixing roller becomes the final maintenance temperature value.

In printing a sheet set in the sheet feeding unit (i.e., a type of sheet that is commonly used), the temperature of the second fixing unit 116 in the normal mode is used. On the other hand, as for printing a sheet that is included in the database but is not set in the sheet feeding unit (i.e., a type of sheet not commonly used and thus fed manually), the temperature of the second fixing unit 116 in the power-saving mode will be used.

As described above, by controlling the temperature of the second fixing unit 116, the power consumption of the second fixing unit 116 can be reduced without deteriorating the throughput of printing.

According to the present embodiment, even if a plurality of sheets having different characteristics are printed while the sheets to be printed are changed, the adjustment time of the second fixing unit 116, which is required when a different print medium is printed, can be greatly reduced.

According to the processing in FIG. 13, a temperature corresponding to each registered sheet type multiplied by a power-saving coefficient is compared to a temperature corresponding to a type of sheet set in each sheet feeding unit, and a temperature that allows printing of any of the registered sheets is obtained. However, the temperatures of the registered sheets multiplied by a power-saving coefficient can be compared to obtain a temperature that allows printing of any of the registered sheets while eliminating steps S1306 through S1310. Further, the temperatures of sheets set in the sheet feeding units can be compared to obtain a temperature that allows printing of any of the registered sheets while eliminating steps S1302 through S1305 and step S1311.

Even in such a configuration, the power consumption of the second fixing unit 116 can be reduced without deteriorating the throughput of the printing operation.

Second Embodiment

According to the above-described first exemplary embodiment, the temperature of the fixing roller 201 included in the second fixing unit 116 during printing is controlled. According to a second exemplary embodiment of the present invention, the temperature of each component included in the second fixing unit 116 as well as the temperature of the fixing roller 201 are controlled during printing. As described above, the temperature of each of the fixing roller 201, the external heating rollers 202 and 203, and the conveying belt 205 is independently adjustable (independently controllable) so that an optimum amount of heat can be applied to the sheet onto which the toner image is fixed according to the type of the sheet.

According to the present exemplary embodiment, a table similar to that illustrated in FIG. 5 for the fixing roller 201 will be prepared for each component included in the second fixing unit 116. In other words, a table including each component included in the second fixing unit 116, each setting value of temperature of the component required in the fixing processing, the surface property and grammage of a plurality of types of sheets that are usable by the printing apparatus is prepared in advance. Data of the components in a table format will be stored in the RAM 306 or the hard disk 311 in advance.

By multiplying each temperature value defined by the components of the second fixing unit 116 in the table format by a predetermined power-saving coefficient, a required temperature of each component in the fixing roller 201 in the power saving mode can be calculated. The power-saving coefficient is stored in the ROM 310 or the hard disk 311 of the main controller 301.

Figure 14:
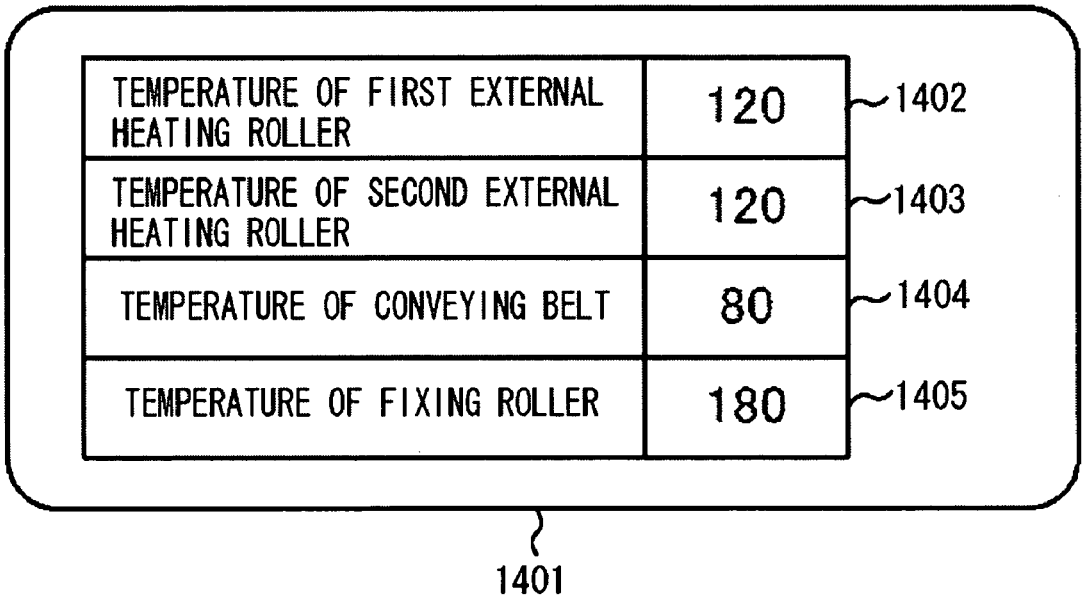
FIG. 14 illustrates a data format of a second temperature management table used for setting a temperature value of each component included in the second fixing unit.

FIG. 14 illustrates a data format of a second temperature management table used for setting a preset temperature value of a heater at the time each component included in the second fixing unit 116 performs the fixing processing.

In FIG. 14, data in a second temperature management table 1401 is stored in the RAM 306 or the hard disk 311 in the form of a second temperature management table used for setting each temperature value of each component in the second fixing unit 116 at the time the fixing processing is performed.

A temperature of the first external heating roller 202 in the second fixing unit 116 which is required when the fixing processing is performed is displayed in a field 1402. A temperature of the second external heating roller 203 in the second fixing unit 116 which is required when the fixing processing is performed is displayed in a field 1403.

A temperature of the conveying belt 205 in the second fixing unit 116 which is required when the fixing processing is performed is displayed in a field 1404. A temperature of the fixing roller 201 in the second fixing unit 116 which is required when the fixing processing is performed is displayed in a field 1405.

Figure 15:
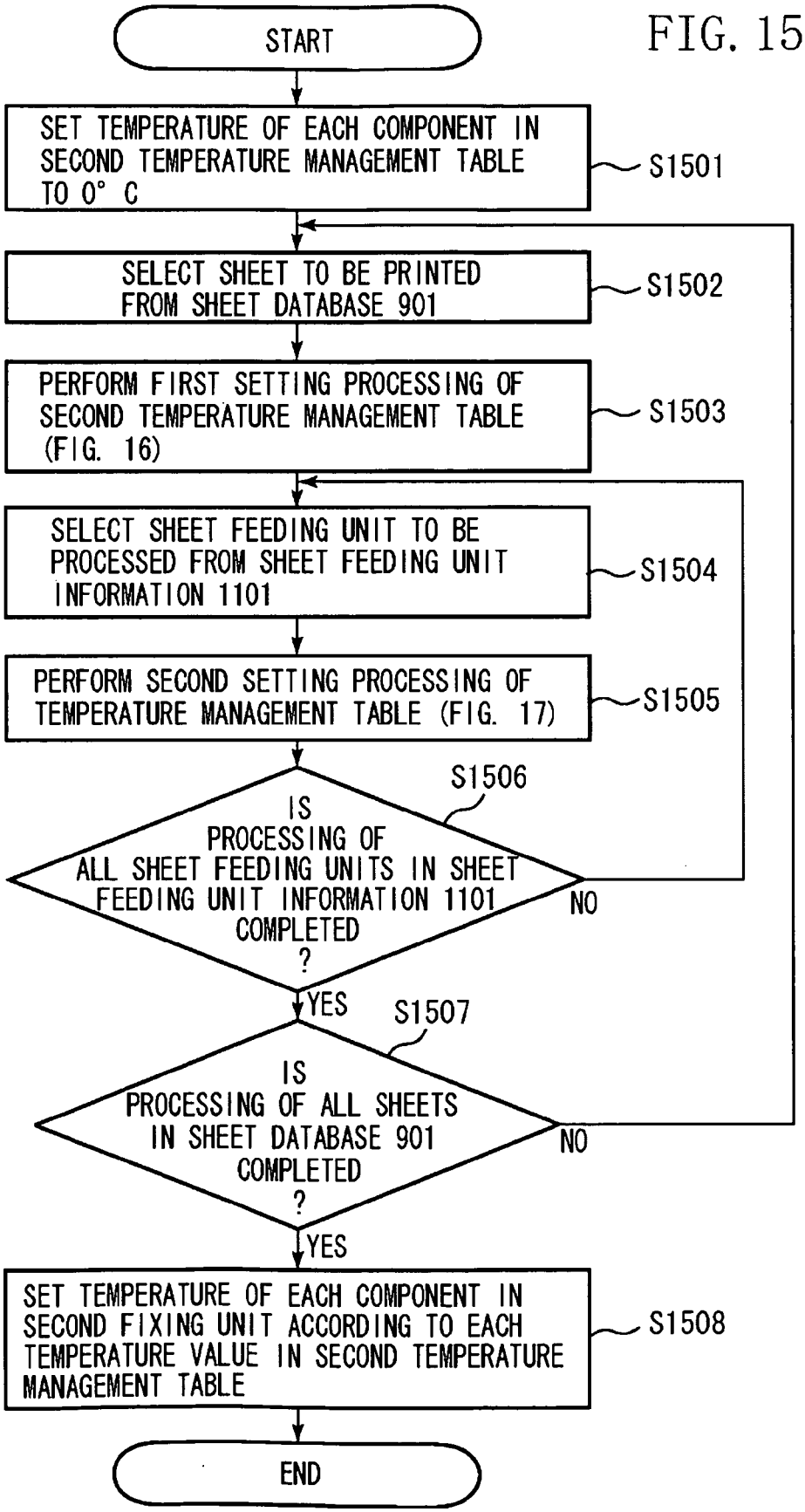
FIG. 15 is a flowchart illustrating procedures for controlling the second fixing unit when the mode of the printing apparatus is changed to a power saving mode according to a second exemplary embodiment of the present invention.

The flowchart in FIG. 15 illustrates procedures for controlling the fixing unit when the mode of the printing apparatus is changed to the power saving mode according to the second exemplary embodiment of the present invention. The control steps in the flowchart are realized by the CPU 305 executing a program stored in the ROM 310.

The control steps in the flowchart illustrated in FIG. 15 are executed when registration of a sheet type is instructed via the operation unit 104 or the network cable 303 at the time the mode of the printing apparatus is changed to the power saving mode. The control steps in the flowchart are also executed when the content of the table in FIG. 5 is changed or when an additional sheet is set in the sheet feeding unit 105 or 106, or when a sheet set in the sheet feeding unit 105 or 106 is replaced with a different type of sheet, at the time the mode of the printing apparatus is changed to the power saving mode.

According to the present exemplary embodiment, the maintenance temperature value of the fixing roller 201 in the first fixing unit 115 in the power saving mode is 240° C. regardless of the sheet type.

In step S1501, the CPU 305 sets the temperatures displayed in the fields 1402 to 1405 illustrated in FIG. 14 to "0° C.". The field 1402 is where the temperature of the first external heating roller is displayed and the field 1403 is where the temperature of the second external heating roller is displayed. Further, the field 1404 is where the temperature of the conveying belt is displayed and the field 1405 is where the temperature of the fixing roller is displayed. Temperatures displayed in the fields 1402 to 1405 are maintenance temperature values, which are temperatures that the components are required to maintain.

In step S1502, the CPU 305 determines a sheet to be processed according to the sheet in the sheet database 901.

In step S1503, the CPU 305 performs setting processing (the first setting processing) of the components in the second temperature management table 1401 with respect to the sheet selected in step S1502. Details of the first setting processing will be described below referring to the flowchart illustrated in FIG. 16.

In step S1504, the CPU 305 selects a sheet feeding unit that goes through steps S1505 and S1506. The sheet feeding unit is selected from the sheet feeding units included in the sheet feeding unit information 1101. For example, a sheet feeding unit of deck ID: 001 is selected.

In step S1505, the CPU 305 performs processing (the second setting processing) of the components in the second temperature management table 1401 with respect to the sheet feeding unit selected in step S1504. Details of the second setting processing will be described below referring to the flowchart illustrated in FIG. 17.

In step S1506, the CPU 305 determines whether the selection of all of the sheet feeding units in step S1504 is completed. If the CPU 305 determines that the selection of all of the sheet feeding units in step S1504 is not completed (NO in step S1506), then the process returns to step S1504.

On the other hand, in step S1506, if the CPU 305 determines that the selection of all of the sheet feeding units is completed (YES in step S1506), the process proceeds to step S1507.

In step S1507, the CPU 305 determines whether processing of all of the sheets registered in the sheet database 901 is completed. If the CPU 305 determines that the processing of all of the sheets registered in the sheet database 901 is not completed or a sheet that has not been subjected to the processing in steps S1503 through S1506 exists (NO in step S1507), then the process returns to step S1502.

On the other hand, in step S1507, if the CPU 305 determines that the processing of all of the sheets registered in the sheet database 901 is completed (YES in step S1507), then the process proceeds to step S1508.

In step S1508, the CPU 305 sets the temperature of each component included in the second fixing unit 116 as the temperature value to be set in the second temperature management table 1401, and then the process ends.

Next, details of the first setting processing with respect to the second temperature management table 1401 performed in step S1503 in FIG. 15 will be described referring to the flowchart illustrated in FIG. 16.

Figure 16:
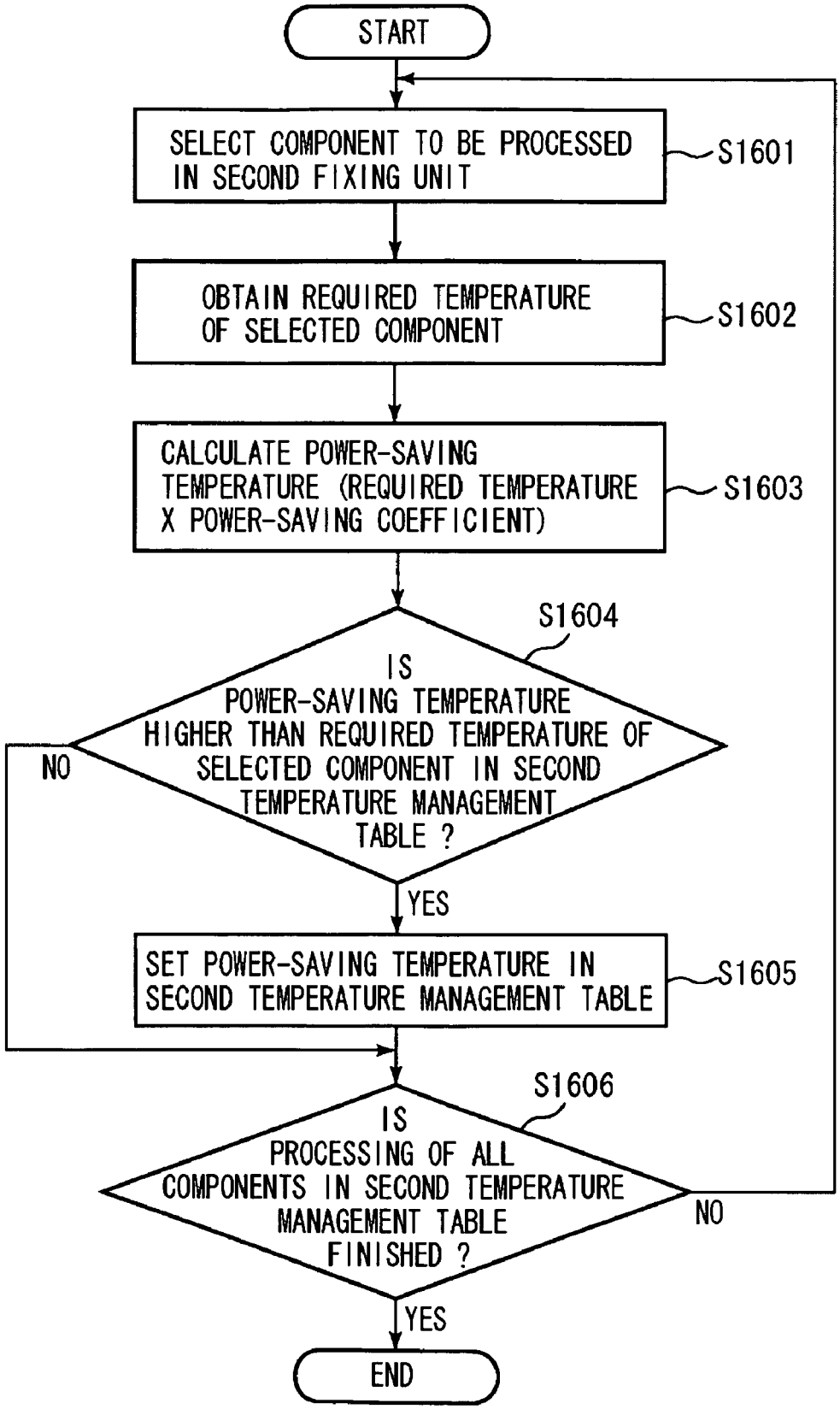
FIG. 16 is a flowchart illustrating procedures used for processing first setting processing referred to in step S1503 illustrated in FIG. 15.

The flowchart in FIG. 16 illustrates control procedures of the first setting processing referred to in step S1503 in FIG. 15. The control steps in the flowchart are realized by the CPU 305 executing a program stored in the ROM 310.

In step S1601, the CPU 305 selects a component included in the second fixing unit according to the component information registered in the second temperature management table 1401.

In step S1602, the CPU 305 obtains a temperature which the component selected in step S1601 requires in fixing an image onto the sheet selected in step S1502 in FIG. 15 according to the above-described table format which includes the surface property and grammage of sheets and the required temperature of each component.

In step S1603, the CPU 305 stores a power-saving temperature of the component selected in step S1601. The power-saving temperature is obtained by multiplying the required temperature obtained in step S1602 by a power-saving coefficient, which is set in advance.

In step S1604, the CPU 305 compares the power-saving temperature of the component, which is obtained in step S1603, with the temperature of the component in the second temperature management table 1401. If the CPU 305 determines that the power-saving temperature of the component is lower than or equal to the temperature of the component in the second temperature management table 1401 (NO in step S1604), then the process proceeds to step S1606.

On the other hand, in step S1604, if the CPU 305 determines that the power-saving temperature of the component is higher than the temperature of the component in the second temperature management table 1401 (YES in step S1604), then the process proceeds to step S1605.

In step S1605, the CPU 305 sets the power-saving temperature of the component as the maintenance temperature value of the component. The power-saving temperature is set in the second temperature management table 1401.

In step S1606, the CPU 305 determines whether the processing in steps S1602 to S1605 is completed with respect to all of the components registered in the second temperature management table 1401. If the CPU 305 determines that the processing in steps S1602 to S1605 is not completed with respect to all of the components registered in the second temperature management table 1401 (NO in step S1606), then the process returns to step S1601.

On the other hand, in step S1606, if the CPU 305 determines that the processing in steps S1602 to S1605 is completed with respect to all of the components registered in the second temperature management table 1401 (YES in step S1606), then the process ends and returns to the flowchart in FIG. 15.

Next, details of the second setting processing with respect to the second temperature management table 1401 performed in step S1505 in FIG. 15 will be described referring to the flowchart illustrated in FIG. 17.

Figure 17:
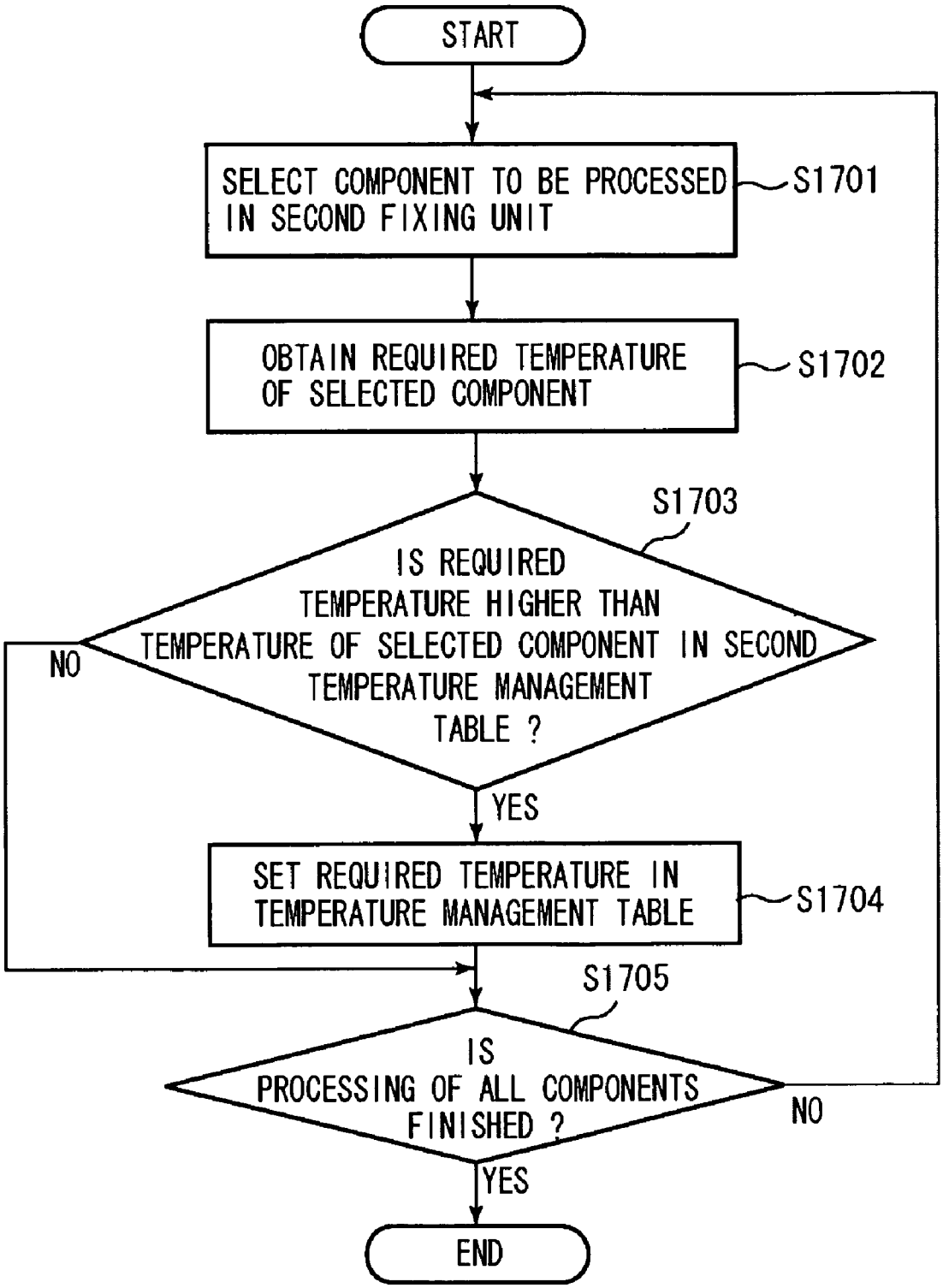
FIG. 17 is a flowchart illustrating procedures used for processing second setting processing referred to in step S1505 illustrated in FIG. 15.

The flowchart in FIG. 17 illustrates control procedures of the second setting processing performed in step S1505 in FIG. 15. The control steps in the flowchart are realized by the CPU 305 executing a program stored in the ROM 310.

In step S1701, the CPU 305 selects a component included in the second fixing unit that is targeted for processing in steps S1702 through S1705 according to the component information registered in the second temperature management table 1401.

In step S1702, the CPU 305 obtains a temperature which the component selected in step S1701 requires in fixing an image onto the sheet selected in step S1502 in FIG. 15 according to the above-described table format which includes the surface property and grammage of sheets and the required temperature of each component.

In step S1703, the CPU 305 compares the required temperature which is obtained in step S1702 (i.e., the required temperature of the component selected in step S1701) with the temperature of the component in the second temperature management table 1401. If the CPU 305 determines that the required temperature is lower than or equal to the temperature in the second temperature management table 1401 (NO in step S1703), then the process proceeds to step S1705.

On the other hand, in step S1703, if the CPU 305 determines that the power-saving temperature of the component is higher than the temperature of the component in the second temperature management table 1401 (YES in step S1703), then the process proceeds to step S1704.

In step S1704, the CPU 305 sets the power-saving temperature of the component as the maintenance temperature value of the component. The power-saving temperature is set in the second temperature management table 1401.

In step S1705, the CPU 305 determines whether the processing in steps S1702 through S1704 is completed with respect to all of the components registered in the second temperature management table 1401. If the CPU 305 determines that the processing in steps S1702 through S1704 is not completed with respect to all of the components registered in the second temperature management table 1401 (NO in step S1705), then the process returns to step S1701.

On the other hand, in step S1705, if the CPU 305 determines that the processing in steps S1702 through S1704 is completed with respect to all of the components registered in the second temperature management table 1401 (YES in step S1705), then the process ends and the process returns to the flowchart in FIG. 15.

According to the flowchart illustrated in FIG. 15, temperatures (maintenance temperature values) of each heater included in the fixing roller 201, the external heating rollers 202 and 203, and the conveying belt 205, all of which are included in the second fixing unit, that are required to maintain when the second fixing unit 116 is not executing the fixing processing, are set in step S1503 (the first setting processing described in FIG. 16) or step S1505 (the second setting processing described in FIG. 17). Further, the maintenance temperature value of each of the plurality of sheets set in the storage unit is calculated in step S1305 or step S1309, and the maximum value of the calculated maintenance temperature values is used as the final maintenance temperature value. Then, the CPU 305 controls the fixing roller 201, the external heating rollers 202 and 203, and the conveying belt 205, each of which is included in the second fixing unit 116, so that each temperature of each of the heaters of the components is equal to the maintenance temperature set in step S1503 or in step S1505.

As described above, by controlling the temperature of each component included in the second fixing unit 116, the power consumption of the second fixing unit 116 can be reduced with reliability without deteriorating the throughput of printing.

According to the present embodiment, even if a plurality of sheets having different characteristics are printed while the sheets to be printed are changed, the adjustment time of the second fixing unit 116, which is required when a different print medium is printed, can be greatly reduced.

According to the processing in FIG. 15, a temperature corresponding to each registered sheet type multiplied by a power-saving coefficient is compared to a temperature corresponding to a type of sheet set in each sheet feeding unit, and a temperature that allows printing of any of the registered sheets is obtained.

However, the temperatures of the registered sheets multiplied by a power-saving coefficient can be compared to obtain a temperature that allows printing of any of the registered sheets while eliminating steps S1504 through S1506.

Further, the temperatures of sheets set in the sheet feeding units can be compared to obtain a temperature that allows printing of any of the registered sheets while eliminating steps S1502, S1503, and S1507.

Even in such a configuration, the power consumption of the second fixing unit 116 can be reduced without decreasing the throughput of the printing operation.

Third Embodiment

Figure 18:
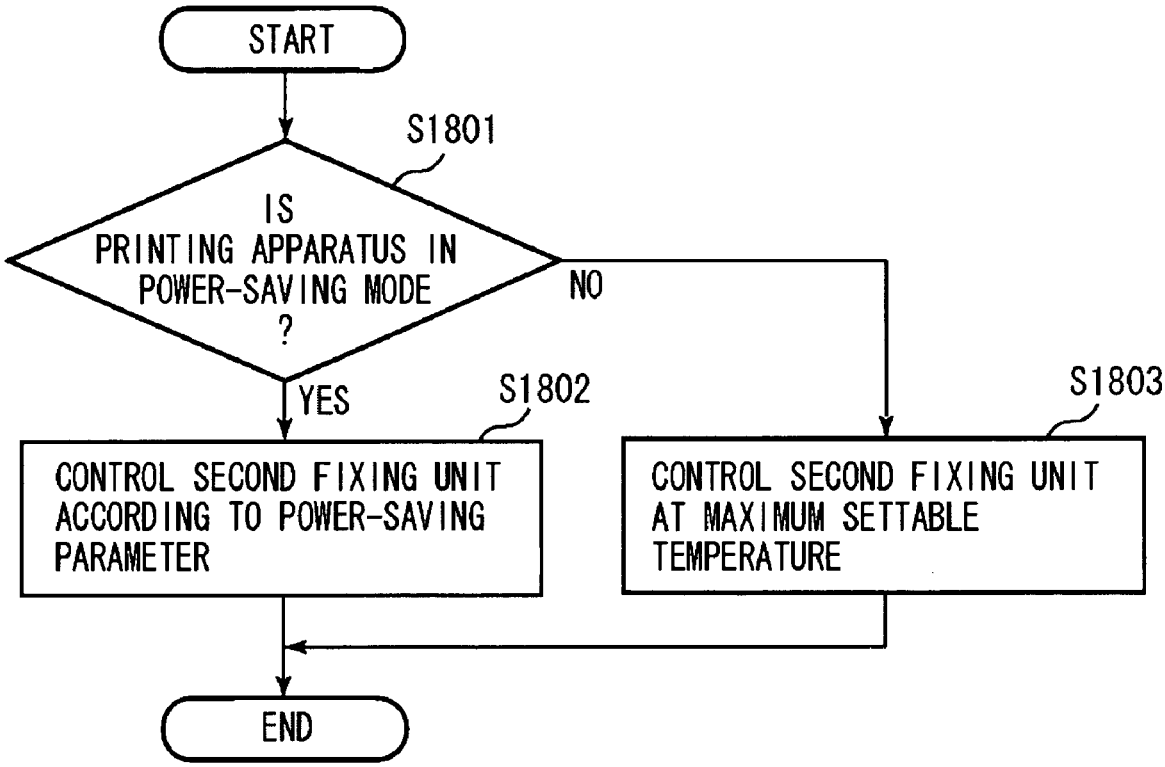
FIG. 18 is a flowchart illustrating procedures for controlling the printing apparatus according to a third exemplary embodiment of the present invention.

FIG. 18 is a flowchart illustrating procedures for controlling the printing apparatus according to a third exemplary embodiment of the present invention. The control steps in the flowchart are realized by the CPU 305 executing a program stored in the ROM 310.

In step S1801, the CPU 305 determines whether the printing apparatus is set in the power-saving mode. Information indicating whether the printing apparatus is in the power-saving mode is stored in the RAM 306. That is, when the mode of the printing apparatus is changed to the power-saving mode, the CPU 305 stores information indicating that the printing apparatus is in such a mode in the RAM 306. When the mode of the printing apparatus returns to the normal mode from the power-saving mode, the CPU 305 stores information indicating that the printing apparatus is in the normal mode in the RAM 306.

In step S1801, if the CPU 305 determines that the printing apparatus is in the power-saving mode (YES in step S1801), the process proceeds to step S1802. In step S1802, the CPU 305 controls the second fixing unit 116 according to the control procedures that are described referring to the flowchart in FIG. 13 (the first exemplary embodiment) or the flowchart in FIG. 15 (the second exemplary embodiment).

On the other hand, in step S1801, if the CPU 305 determines that the printing apparatus is not in the power-saving mode (NO in step S1801), then the process proceeds to step S1803. In step S1803, the CPU 305 maintains the temperature of the second fixing unit 116 at a maximum allowable temperature.

As described above, when the second fixing unit is in the power-saving mode, power consumption of the second fixing unit 116 can be reduced with reliability without deteriorating the throughput of printing. According to the present embodiment, even if a plurality of sheets having different characteristics are printed while the sheets to be printed are changed, the adjustment time of the second fixing unit 116, which is required when a different print medium is printed, can be greatly reduced.

Configuration and content of the above-described data is not limited to such an example. For example, data with various configuration and content can be applied to the present invention.

Fourth Embodiment

In the first to third embodiments of the present invention, the calculation of the temperature of the second fixing unit in power-saving mode has been determined based on the surface property and grammage of the types of sheets usable by the printing apparatus. In the fourth embodiment, the calculation of the temperature of the second fixing unit in different circumstances is performed in advance and a look-up table is provided to the printing apparatus. Accordingly, a method of forming a look-up table, a look-up table, and a printing apparatus that uses the look-up table will now be described.

A printing apparatus may be designed to work with a set of different types of papers, transparencies, etc. (hereinafter collectively referred to as "papers" despite the fact that they may not be made of paper). Such a set of papers may be papers approved for use with the printing apparatus by the manufacturer, for example. In the fourth embodiment, the printing apparatus is designed to work with a selection of papers forming a set $S_1$ to $S_N$. Further, as previously described with reference to FIG. 1, the printing apparatus has two sheet feeding units 105 and 106. A user may identify (i.e. set) paper types stored in the sheet feeding units 105 and 106 to the printing apparatus via the operation unit 104. It is therefore possible to identify all of the possible ways in which paper types may be set in the printing apparatus as ordered pairs of papers ($S_i$, $S_j$) where $1 \leqq i \leqq N$, and $1 \leqq j \leqq N$.

For each possible setting of the printing apparatus ($S_i$, $S_j$) a pre-set temperature value $T_{ij}$ may be set. The temperature value $T_{ij}$ is set in a similar manner to the method described with respect to FIG. 13. For each state ($S_i$, $S_j$), the following steps are performed:

1) $T_{i,j}$ is set equal to 0° C.
2) A preferred temperature for the second fixing unit when printing on a paper of type $S_i$ is obtained. If the preferred temperature for sheet of type $S_i$ is not zero, $T_{i,j}$ is set to the preferred temperature for sheet of type $S_i$.
3) A preferred temperature for the second fixing unit when printing on paper of type $S_j$ is obtained. If the predetermined temperature for the sheet of type $S_j$ is higher than $T_{i,j}$, $T_{i,j}$ is set to the preferred temperature of sheet of type $S_j$.
4) For each of sheet type of the aforementioned set of sheets, $S_k$, $k \neq i$ or j, a preferred temperature $T_k$ of the second fixing unit when printing to paper of type $S_k$ is obtained. The temperature $T_k$ is multiplied by the power saving coefficient to obtain a modified temperature $T'_k$. If $T'_k$ is greater than $T_{i,j}$ then $T_{i,j}$ is set equal to $T'_k$.

In this way a look-up table $T_{i,j}$ of values is obtained. In alternative embodiments in which the printing apparatus has more than two sheet feeding units, the above method may be modified to generate a large look-up table accommodating the additional possible combinations of paper types.

A printing apparatus, of the type previously described, may be supplied with the look-up table $T_{i,j}$ already installed in it. Alternatively, the look-up table may be later installed or updated. The updating of the look-up table may be performed by software update of the printing apparatus.

In operation, when performing printing, the CPU 305 controls the first fixing unit to maintain a preset temperature of 240° C. depending on the grammage and surface type of the sheet being printed according to the table shown in FIG. 4. The CPU 305 controls the second fixing unit to maintain a predetermined temperature depending on the grammage and surface type of the sheet being printed in accordance with the table shown in FIG. 5.

If the printing apparatus enters the power-saving mode, the temperature of the first printing unit is maintained at 240° C. regardless of the paper types set for the sheet feeding units 105 and 106.

In the power-saving mode, the CPU 305 controls the temperature of the second fixing unit to be equal to $T_{i,j}$ where $S_i$ represents the type of sheet set for the first sheet feeding unit 105 and $S_j$ represents the type of sheet set for the second sheet feeding unit 106.

In this way, control of the temperatures of the first fixing unit and second fixing unit may be performed without the need to perform calculations on the printing apparatus as described in the earlier embodiments.

The use of look-up tables, of the type described above, can readily be extended to the situation in which the first and second fixing units each have multiple temperature controlled components (similar to the second embodiment) or the case in which, when not in the power-saving mode, the second fixing unit is maintained at the maximum allowable temperature (similar to the third embodiment]

A further embodiment provides a method for creating a look-up table for a printing apparatus, the printing apparatus comprising a fixing unit configured to perform fixing processing for fixing a toner image to a sheet by heating the sheet with a heating portion, a storage unit, and a control unit configured to control a heating portion to maintain a maintenance temperature during a period when print processing is not performed, the method comprising:

determining a plurality of combinations of types sheets that may be selected within the printing apparatus;

for each of the determined combinations calculating a maximum temperature value among preset temperature values associated with the types of sheets selected in the printing apparatus and values obtained by multiplying the preset temperature values associated with types of sheet identified in the printing apparatus but not selected by the specifying means by a predetermined coefficient.

A further embodiment of the present invention provides a look-up table comprising, for each of a plurality of combinations of types of sheets that may be selected within a printing apparatus, a temperature value corresponding to a maximum value among the preset temperature values associated with the type of sheets selected by the user and values obtained by multiplying the preset temperature values associated with types of sheet identified within the printing apparatus but not specified by the specifying means by a predetermined coefficient.

The above-described exemplary embodiments can be also realized with, for example, a system, an apparatus, a method, a program, or a storage medium. More specifically, the above-described exemplary embodiments can be applied to a system including a plurality of devices or an apparatus including a single device.

FIG. 19 is a memory map of a storage medium (recording medium) storing various data processing programs that are readable by the printing apparatus according to an exemplary embodiment of the present invention.

Although not illustrated, information for managing a program group stored in the storage medium, for example, version information and author information, is stored in the storage medium. Furthermore, although not illustrated, information which relies on the OS on a program readout side, for example, an icon or the like used for identifying a program, can also be stored in the storage medium.

Further, data which is dependent on various types of programs is controlled by a directory information management unit. Furthermore, programs for installing various programs in a computer and a decompression program which is used when a program to be installed is compressed are stored in the storage medium.

Also, each function realized by an execution of a process of each flowchart illustrated in FIGS. 13, 15, 16, 17, and 18 according to the above-described embodiments can also be realized by a host computer using a program installed from an external device. In this case, the above-described embodiments can also be applied when an information group including a program is provided to an output apparatus from a storage medium, such as a CD-ROM, a flash memory, a floppy disk, or an external storage medium, via a network.

The present invention can be also achieved by supplying a storage medium storing software program code which is configured to realize a function of the above-described exemplary embodiments, to a system or an apparatus and reading out and executing the program code stored in the storage medium by a computer (or CPU or MPU) of the system or the apparatus.

As described above, the temperature of the second fixing unit of the printing apparatus is set based on a setting of a parameter of a print process of a sheet registered in a database used for managing detailed parameters including the surface property and grammage of the sheet (this parameter is the temperature of the second fixing unit) and information (surface property, grammage) on the sheet set in the sheet feeding unit information according to the printing apparatus of the exemplary embodiments of the present invention. With this configuration, even when a plurality of sheets having different characteristics are printed, while the sheets to be printed are changed, by a printing apparatus having a plurality of fixing units, consumption of unnecessary power can be avoided without decreasing throughput.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-124782 filed May 12, 2008, which is hereby incorporated by reference herein in its entirety.

What is claimed is:

1. A printing apparatus comprising:

a first fixing unit configured to perform fixing processing for fixing a toner image to a sheet;

a setting unit configured to set a plurality of types of sheets used for a print processing;

a comparing unit configured to compare a plurality of preset temperatures each of which is associated with one of the plurality of types of sheets set by the setting unit; and a control unit configured to determine a maintenance temperature, based on a result of the comparison by the comparing unit, and control the first fixing unit to maintain the maintenance temperature during a period when print processing is not performed.

2. The printing apparatus according to claim 1, further comprising:

a plurality of sheet holding units configured to hold sheets used for the print processing, wherein the setting unit sets the plurality of types of sheets to the plurality of sheet holding units.

3. The printing apparatus according to claim 1, wherein, in a case where a content of the setting is changed by the setting unit, the control unit determines the maintenance temperature.

4. The printing apparatus according to claim 1, wherein, in a case where the printing apparatus shifts into a second state in which power consumption is lower than in a first state, the control unit determines the maintenance temperature.

5. The printing apparatus according to claim 1, further comprising:

a second fixing unit configured to perform fixing processing for fixing a toner image to a sheet, wherein the first fixing unit performs the fixing processing to the sheet to which the fixing processing is performed by the second fixing unit.

6. A method for controlling a printing apparatus including a first fixing unit configured to perform fixing processing for fixing a toner image to a sheet, and a control unit configured to control the first fixing unit, the method comprising:

a setting step of setting a plurality of types of sheets used for a print processing;

a comparing step of comparing a plurality of preset temperatures each of which is associated with one of the plurality of types of sheets set in the setting step;

a determining step of determining a maintenance temperature based on a result of the comparison in the comparing step; and a controlling step of controlling the first fixing unit to maintain the maintenance temperature during a period when print processing is not performed.

7. A non-transitory computer-readable medium having stored thereon a computer program comprising program code having computer-executable instructions for causing a computer to execute the method according to claim 6.

8. A printing apparatus comprising:

a first fixing unit configured to perform fixing processing for fixing a toner image to a sheet;

a setting unit configured to set a plurality of types of sheets used for a print processing a comparing unit configured to compare a plurality of preset temperatures each of which is associated with one of the plurality of types of sheets set by the setting unit; and a control unit configured to control the first fixing unit to maintain a maintenance temperature during a period when print processing is not performed, wherein the maintenance temperature is a highest preset temperature of the compared plurality of preset temperatures each of which is associated with one of the plurality of types of sheets set by the setting unit.

9. The printing apparatus according to claim 8, further comprising:

a plurality of sheet holding units configured to hold sheets used for the print processing, wherein the setting unit sets the plurality of types of sheets to the plurality of sheet holding units.

10. The printing apparatus according to claim 8, wherein, in a case where a content of the setting is changed by the setting unit, the control unit determines the maintenance temperature.

11. The printing apparatus according to claim 8, wherein, in a case where the printing apparatus shifts into a second state in which power consumption is lower than in a first state, the control unit determines the maintenance temperature.

12. The printing apparatus according to claim 8, further comprising:

a second fixing unit configured to perform fixing processing for fixing a toner image to a sheet, wherein the first fixing unit performs the fixing processing to the sheet to which the fixing processing has been performed by the second fixing unit.

13. A method of controlling a printing apparatus including a first fixing unit configured to perform fixing processing for fixing a toner image to a sheet and a control unit configured to control the first fixing unit, the method comprising:

a setting step of setting a plurality of types of sheets used for a print processing a comparing step of comparing a plurality of preset temperatures each of which is associated with one of the plurality of types of sheets set in the setting step; and a controlling step of controlling the first fixing unit to maintain a maintenance temperature during a period when print processing is not performed, wherein the maintenance temperature is a highest preset temperature of the compared plurality of preset temperatures each of which is associated with one of the plurality of types of sheets set in the setting step.

14. A non-transitory computer-readable medium having stored thereon a computer program comprising program code having computer-executable instructions for causing a computer to execute the method according to claim 13.

* * * * *